US010625505B2

(12) United States Patent
Arakane

(10) Patent No.: US 10,625,505 B2
(45) Date of Patent: Apr. 21, 2020

(54) METHOD AND INKJET PRINTER FOR ACQUIRING GAP INFORMATION

(71) Applicant: BROTHER KOGYO KABUSHIKI KAISHA, Nagoya, Aichi (JP)

(72) Inventor: Satoru Arakane, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 16/272,382

(22) Filed: Feb. 11, 2019

(65) Prior Publication Data

US 2019/0248136 A1 Aug. 15, 2019

Related U.S. Application Data

(63) Continuation of application No. 15/243,358, filed on Aug. 22, 2016, now Pat. No. 10,201,973, which is a (Continued)

(30) Foreign Application Priority Data

Mar. 30, 2012 (JP) ..... 2012-082618

(51) Int. Cl.
*B41J 2/145* (2006.01)
*B41J 2/21* (2006.01)
(Continued)

(52) U.S. Cl.
CPC ..... *B41J 2/145* (2013.01); *B41J 2/2135* (2013.01); *B41J 11/005* (2013.01); *B41J 19/145* (2013.01);
(Continued)

(58) Field of Classification Search
None
See application file for complete search history.

(56) References Cited

U.S. PATENT DOCUMENTS 5,366,301 A 11/1994 Martin et al.
5,515,094 A * 5/1996 Tanaka ..... B41J 11/005 347/104
(Continued)

FOREIGN PATENT DOCUMENTS

CN 1990242 A 7/2007
CN 101058244 A 10/2007
(Continued)

OTHER PUBLICATIONS

Extended European Search Report dated Jul. 11, 2013 from related EP 12199734.0 from related U.S. Appl. No. 13/729,697.
(Continued)

*Primary Examiner* — Alejandro Valencia
(74) *Attorney, Agent, or Firm* — Scully, Scott, Murphy & Presser, P.C.

(57) ABSTRACT

An inkjet printer including an inkjet head, a head scanning unit, a wave shape generating mechanism to deform a recording medium into a predetermined wave shape, an obtaining device to obtain information concerning a type of the recording medium to be used in a printing operation, a gap information storing device to store gap information related to a gap between an ink discharging surface and the recording medium in association with a predetermined type of the recording medium, the gap information being acquired from a predetermined range in the recording medium, and a correcting device to correct the gap information according to the type of the recording medium obtained by the obtaining device when the type of the recording medium obtained by the obtaining device is different from the predetermined type of the recording medium stored in association with the gap information, is provided.

6 Claims, 11 Drawing Sheets

Related U.S. Application Data continuation of application No. 13/729,386, filed on Dec. 28, 2012, now Pat. No. 9,481,189.

(51) Int. Cl.

| | |
|---|---|
| ***B41J 11/00*** | (2006.01) |
| ***B41J 19/14*** | (2006.01) |
| ***B41J 29/393*** | (2006.01) |
| ***B41J 25/308*** | (2006.01) |

(52) U.S. Cl.

CPC ..... *B41J 25/308* (2013.01); *B41J 25/3082* (2013.01); *B41J 29/393* (2013.01)

(56) References Cited

U.S. PATENT DOCUMENTS

| | | | | |
|---|---|---|---|---|
| 5,659,404 | A | 8/1997 | Matsuda | |
| 5,847,719 | A | 12/1998 | Yamaguchi et al. | |
| 6,092,939 | A | 7/2000 | Nishikori et al. | |
| 6,310,637 | B1 | 10/2001 | Shimada et al. | |
| 6,336,703 | B1 | 1/2002 | Otsuki | |
| 6,604,803 | B1 | 8/2003 | Hanabusa et al. | |
| 6,827,418 | B2 | 12/2004 | Otokita | |
| 6,900,449 | B2 | 5/2005 | Bolash et al. | |
| 6,964,476 | B2 | 11/2005 | Okamoto | |
| 7,083,245 | B2 | 8/2006 | Yamamoto | |
| 7,267,419 | B2 | 9/2007 | Yamasaki | |
| 7,309,179 | B2 | 12/2007 | Toran et al. | |
| 7,530,659 | B2 | 5/2009 | Doherty et al. | |
| 7,533,954 | B2 * | 5/2009 | Nakazawa | B41J 11/009 347/105 |
| 8,118,382 | B2 | 2/2012 | Hampel et al. | |
| 8,118,422 | B2 | 2/2012 | Hibbard et al. | |
| 8,282,194 | B2 | 10/2012 | Ozawa | |
| 8,556,382 | B2 | 10/2013 | Kang | |
| 8,714,693 | B2 | 5/2014 | Arakane | |
| 8,740,328 | B2 | 6/2014 | Terada | |
| 8,882,215 | B2 | 11/2014 | Arakane | |
| 8,888,227 | B2 | 11/2014 | Arakane | |
| 9,156,295 | B2 | 10/2015 | Arakane | |
| 9,162,441 | B1 | 10/2015 | Noda | |
| 9,162,502 | B2 | 10/2015 | Terada | |
| 9,315,056 | B2 | 4/2016 | Arakane | |
| 9,481,189 | B2 | 11/2016 | Arakane | |
| 9,834,018 | B2 | 12/2017 | Terada | |
| 9,873,272 | B2 | 1/2018 | Arakane | |
| 10,272,706 | B2 | 4/2019 | Arakane | |
| 2002/0196298 | A1 | 12/2002 | Cheng et al. | |
| 2003/0001939 | A1 * | 1/2003 | Scofield | B41J 2/125 347/105 |
| 2003/0048345 | A1 * | 3/2003 | Matsumoto | B41J 11/005 347/104 |
| 2004/0126164 | A1 | 7/2004 | Ohyama | |
| 2004/0223017 | A1 | 11/2004 | Otsuki | |
| 2005/0052487 | A1 | 3/2005 | Yamasaki | |
| 2005/0168557 | A1 | 8/2005 | Ohyama | |
| 2007/0040878 | A1 | 2/2007 | Ikefuji et al. | |
| 2007/0229562 | A1 | 10/2007 | Doherty et al. | |
| 2007/0291077 | A1 | 12/2007 | Seki et al. | |
| 2008/0150978 | A1 | 6/2008 | Sato et al. | |
| 2009/0085949 | A1 | 4/2009 | Sugiyama et al. | |
| 2009/0122098 | A1 | 5/2009 | Shindo | |
| 2009/0251521 | A1 | 10/2009 | Arai | |
| 2009/0262157 | A1 | 10/2009 | Sato et al. | |
| 2011/0175958 | A1 | 7/2011 | Sato et al. | |
| 2011/0249049 | A1 | 10/2011 | Taira et al. | |
| 2012/0063800 | A1 | 3/2012 | Rossell et al. | |

FOREIGN PATENT DOCUMENTS

| | | | |
|---|---|---|---|
| EP | 0622227 | A2 | 11/1994 |
| EP | 0622227 | A3 | 8/1995 |
| EP | 1160088 | A2 | 12/2001 |
| EP | 1182041 | A1 | 2/2002 |
| EP | 1160088 | A3 | 4/2002 |
| EP | 1449663 | A1 | 8/2004 |
| JP | H08-307688 | A | 11/1996 |
| JP | H10-138463 | A | 5/1998 |
| JP | 11-138923 | A | 5/1999 |
| JP | H11-151242 | A | 6/1999 |
| JP | 2000-71532 | A | 3/2000 |
| JP | 2001-096733 | A | 4/2001 |
| JP | 2002-160357 | A | 6/2002 |
| JP | 2003-54078 | A | 2/2003 |
| JP | 2004-17586 | A | 1/2004 |
| JP | 2004-106978 | A | 4/2004 |
| JP | 3554184 | B2 | 8/2004 |
| JP | 2004-314361 | A | 11/2004 |
| JP | 2006-192636 | A | 7/2006 |
| JP | 2006-192814 | A | 7/2006 |
| JP | 2007-25492 | A | 2/2007 |
| JP | 2007-144666 | A | 6/2007 |
| JP | 2007-144718 | A | 6/2007 |
| JP | 2008-155423 | A | 7/2008 |
| JP | 2008-155424 | A | 7/2008 |
| JP | 2008-230069 | A | 10/2008 |
| JP | 2009-23121 | A | 2/2009 |
| JP | 2009-143152 | A | 7/2009 |
| JP | 2009-178986 | A | 8/2009 |
| JP | 2009-202430 | A | 9/2009 |
| JP | 2009-255386 | A | 11/2009 |
| JP | 2011-218625 | A | 11/2011 |

OTHER PUBLICATIONS

Notice of Allowance dated Dec. 24, 2013 from related U.S. Appl. No. 13/729,697.

Notice of Allowance dated Jul. 18, 2014 from related U.S. Appl. No. 14/223,334.

U.S. Official Action dated Dec. 18, 2014 received in related U.S. Appl. No. 14/542,025.

Notice of Allowance dated Jun. 8, 2015 from related U.S. Appl. No. 14/542,025.

U.S. Official Action dated Mar. 24, 2016 received in related U.S. Appl. No. 14/879,927.

Notice of Allowance dated Aug. 3, 2016 from related U.S. Appl. No. 14/879,927.

Extended European Search Report dated Jul. 9, 2013 from related EP 12199740.7 from related U.S. Appl. No. 13/729,753.

Notice of Allowance dated Jan. 8, 2014 from related U.S. Appl. No. 13/729,753.

Notification of First Office Action dated Sep. 4, 2014 received from the Chinese Patent Office from related Chinese Patent Application No. 201210586540.3, together with an English language translation.

Notice of Allowance dated Sep. 2, 2014 from related U.S. Appl. No. 14/246,238.

Notice of Reasons for Rejection dated Jul. 15, 2014 from related Japanese Application No. 2012-082621, together with an English language translation.

Japanese Official Action dated Feb. 17, 2015 received in related application JP 2012-082621 together with an English language translation.

Notice of Allowance dated Feb. 20, 2015 from related U.S. Appl. No. 14/587,267.

Notice of Allowance dated Jun. 12, 2015 from related U.S. Appl. No. 14/587,267.

Notice of Allowance dated Jul. 23, 2015 from related U.S. Appl. No. 14/587,267.

Official Action dated Jan. 4, 2016 from related U.S. Appl. No. 14/886,527.

Notice of Allowance dated May 27, 2016 from related U.S. Appl. No. 14/886,527.

Japanese Notification of Reasons for Rejection dated Jul. 26, 2016 received in related application JP 2015-173555 together with an English language translation.

Extended European Search Report dated Jul. 9, 2013 from related EP 12199737.3.

(56) References Cited

OTHER PUBLICATIONS

U.S. Office Action dated Feb. 5, 2014 from related U.S. Appl. No. 13/729,386.
U.S. Office Action dated May 13, 2014 from related U.S. Appl. No. 13/729,386.
U.S. Office Action dated Apr. 15, 2015 from related U.S. Appl. No. 13/729,386.
U.S. Office Action dated Nov. 2, 2015 from related U.S. Appl. No. 13/729,386.
Notice of Allowance dated Apr. 18, 2016 from related U.S. Appl. No. 13/729,386.
Notification of Reasons for Rejection dated Sep. 20, 2016 issued in Japanese Application No. 2012-286358.
U.S. Office Action dated Feb. 14, 2017 from related U.S. Appl. No. 15/243,358.
Extended European Search Report dated Jul. 10, 2013 from related EP 12199749.8.
Notice of Allowance dated Jul. 9, 2014 issued in parent case, U.S. Appl. No. 13/728,629.
Office Action dated Jan. 9, 2015 issued in parent case, U.S. Appl. No. 14/535,845.
Office Action dated Jul. 9, 2015 issued in parent case, U.S. Appl. No. 14/535,845.
Japanese Official Action dated Feb. 2, 2016 received in related application JP 2012-286356 together with an English language translation.
Japanese Official Action dated Feb. 2, 2016 received in related application JP 2012-286357 together with an English language translation.
Japanese Official Action dated Feb. 2, 2016 received in related application JP 2012-286358 together with an English language translation.
Notification of Reasons for Rejection dated Jan. 27, 2017 received in related application JP 2015-173555 together with an English language translation.
United States Official Action dated May 5, 2017 received in related U.S. Appl. No. 15/369,323.
United States Notice of Allowance dated Apr. 12, 2017 received in related U.S. Appl. No. 15/278,737.
Extended European Search Report dated Jul. 9, 2013 from related EP 12199743.1.
European Official Action dated Dec. 21, 2015 received in related application EP 12 199 743.1.
United States Official Action dated Jul. 27, 2018 received in related U.S. Appl. No. 15/876,722.
United States Notice of Allowance dated May 25, 2018 received in related U.S. Appl. No. 15/830,424.
United States Official Action dated Mar. 30, 2018 received in related U.S. Appl. No. 15/243,358.
United States Notice of Allowance dated Sep. 4, 2018 received in related U.S. Appl. No. 15/796,935.
United States Official Action dated Oct. 5, 2016 received in related U.S. Appl. No. 15/131,667.
United States Notice of Allowance dated Jul. 17, 2017 received in related U.S. Appl. No. 15/131,667.
United States Notice of Allowance dated May 4, 2017 received in related U.S. Appl. No. 15/131,667.
United States Notice of Allowance dated Feb. 13, 2017 received in related U.S. Appl. No. 15/131,667.
U.S. Office Action dated May 25, 2017 from related U.S. Appl. No. 15/243,358.
U.S. Notice of Allowance dated Sep. 25, 2018 from related U.S. Appl. No. 15/243,358.
U.S. Office Action dated Jul. 27, 2018 from related U.S. Appl. No. 15/876,722.
United States Notice of Allowance dated Sep. 15, 2017 received in related U.S. Appl. No. 15/369,323.
United States Notice of Allowance dated Dec. 13, 2018 received in related U.S. Appl. No. 15/876,722.
Office Action dated Sep. 16, 2019 received in U.S. Appl. No. 16/397,598.
Office Action dated Sep. 17, 2019 received in U.S. Appl. No. 15/471,850.
Office Action dated Sep. 13, 2019 received in U.S. Appl. No. 16/158,955.
Official Action dated Mar. 6, 2020 received in related U.S. Appl. No. 16/251,681.

* cited by examiner

METHOD AND INKJET PRINTER FOR ACQUIRING GAP INFORMATION

CROSS REFERENCE TO RELATED APPLICATION

This application is a continuation application of U.S. application Ser. No. 15/243,358 filed on Aug. 22, 2016 which is a continuation of U.S. application Ser. No. 13/729,386 filed on Dec. 28, 2012, now U.S. Pat. No. 9,481,189 issued on Nov. 1, 2016 which claims priority from Japanese Patent Application No. 2012-082618, filed on Mar. 30, 2012, the entire subject matter of which is incorporated herein by reference.

BACKGROUND

Technical Field

The following description relates to one or more techniques for acquiring gap information related to a gap between an ink discharging surface of an inkjet printer and a recording medium.

Related Art

As an example of inkjet printers configured to perform printing by discharging ink from nozzles onto a recording medium, an inkjet printer has been known that is configured to perform printing by discharging ink onto a recording sheet (a recording medium) from a recording head (an inkjet head) mounted on a carriage reciprocating along a predetermined head-moving direction. Further, the known inkjet printer is configured to cause a feed rollers or corrugated holding spur wheels to press the recording sheet against a surface of a platen that has thereon convex portions and concave portions alternately formed along the head-moving direction, so as to deform the recording sheet in a predetermined wave shape. The predetermined wave shape has mountain portions, which protrude toward an ink discharging surface of the recording head, and valley portions, which are recessed in a direction opposite to the direction toward the ink discharging surface side, alternately arranged along the head-moving direction.

SUMMARY

In the known inkjet printer, levels (amounts) of the gap between the ink discharging surface of the recording head and the recording sheet vary depending on portions (locations) on the recording sheet deformed in the wave shape (hereinafter, which may be referred to as a "wave-shaped recording sheet"). Therefore, when the known inkjet printer performs printing by discharging ink from the recording head onto the wave-shaped recording sheet with the same ink discharging timing as when performing printing on a recording sheet not deformed in such a wave shape, an ink droplet might land in a position deviated from a desired position on the recording sheet. Thus, the positional deviation value with respect to the ink landing position on the recording sheet varies depending on the portions (locations) on the recording sheet.

In view of the above problem, for instance, the following method is considered as a measure for discharging an ink droplet in a desired position on the wave-shaped recording sheet. The method is to adjust ink discharging timing (a moment) to discharge an ink droplet from the inkjet head depending on an amount of the gap between the ink discharging surface of the inkjet head and each individual one of (tops of) the mountain portions and (bottoms of) the valley portions formed on the recording sheet. Further, in order to adjust the ink discharging timing, it is required to detect amounts of the gap between the ink discharging surface of the inkjet head and each individual one of (the tops of) the mountain portions and (the bottoms of) the valley portions on the recording sheet.

In the meantime, the inkjet printer may be used to print images on various types of recording media, such as regular printing paper, gloss sheet, etc. The different types of recording media may be different in their characteristics, such as in rigidity and thickness, and when the recording media are set to be used in the inkjet printer, the difference in characteristics may affect amplitudes of the ripples in the wave shape and heights of the ink landing positions in the recording media differently. In other words, the amounts of the gap between the ink discharging surface of the inkjet head and each area in the recording medium may vary depending on the types of recording media to some extent. Therefore, it is required that the amounts of the gap are detected in consideration of the types of recording media to be used.

Aspects of the present invention are advantageous in that an inkjet printer, by which information concerning a gap between an ink discharging surface of an inkjet head and each individual one of tops of mountain portions and bottoms of valley portions on a recording sheet deformed in a wave shape according to a type of the recording sheet can be acquired, and a method to acquire the information are provided.

According to aspects of the present invention, an inkjet printer is provided. The inkjet printer includes an inkjet head configured to discharge ink droplets from nozzles formed in an ink discharging surface thereof; a head scanning unit configured to move the inkjet head with respect to a recording medium to reciprocate along a head-moving direction, the head-moving direction being parallel with the ink discharging surface of the inkjet head; a wave shape generating mechanism configured to deform the recording medium into a predetermined wave shape that has tops of portions protruding toward the ink discharging surface and bottoms of portions recessed toward a side opposite from the ink discharging surface, the tops and the bottoms being alternately arranged along the head-moving direction; an obtaining device configured to obtain information concerning a type of the recording medium to be used in a printing operation; a gap information storing device configured to store gap information related to a gap between the ink discharging surface and the recording medium in association with a predetermined type of the recording medium, the gap information being acquired from a predetermined range in the recording medium; and a correcting device configured to correct the gap information stored in the gap information storing device according to the type of the recording medium obtained by the obtaining device when the type of the recording medium obtained by the obtaining device is different from the predetermined type of the recording medium stored in association with the gap information.

According to aspects of the present invention, a method configured to be implemented on a control device connected with an inkjet printer, the inkjet printer including an inkjet head configured to discharge ink droplets from nozzles formed in an ink discharging surface thereof; a head scanning unit configured to move the inkjet head with respect to a recording medium to reciprocate along a head-moving direction, the head-moving direction being parallel with the ink discharging surface of the inkjet head; and a wave shape generating mechanism configured to deform the recording medium into a predetermined wave shape that has tops of portions protruding toward the ink discharging surface and bottoms of portions recessed toward a side opposite from the ink discharging surface, the tops and the bottoms being alternately arranged along the head-moving direction. The method includes steps of: acquiring gap information related to a gap between the ink discharging surface and the recording medium from a predetermined range in the recording medium; and correcting the acquired gap information according to a type of the recording medium when the type of the recording medium is different from a predetermined type of the recording medium having the predetermined range, from which the gap information is acquired.

According to aspects of the present invention, an inkjet printer is provided. The inkjet head includes an inkjet head configured to discharge ink droplets from nozzles formed in an ink discharging surface thereof; a wave shape generating mechanism configured to deform a recording medium into a predetermined wave shape that has tops of portions protruding toward the ink discharging surface and bottoms of portions recessed toward a side opposite from the ink discharging surface, the tops and the bottoms being alternately arranged along a predetermined direction; and a control device. The control device is configured to obtain information concerning a type of the recording medium to be used in a printing operation; store gap information related to a gap between the ink discharging surface and the recording medium in association with a predetermined type of the recording medium, the gap information being acquired from a predetermined range in the recording medium; and correct the stored gap information according to the obtained type of the recording medium to be used in the printing operation when the obtained type of the recording medium to be used in the printing operation is different from the predetermined type of the recording medium being stored in association with the gap information.

BRIEF DESCRIPTION OF THE ACCOMPANYING DRAWINGS

Figure 1:
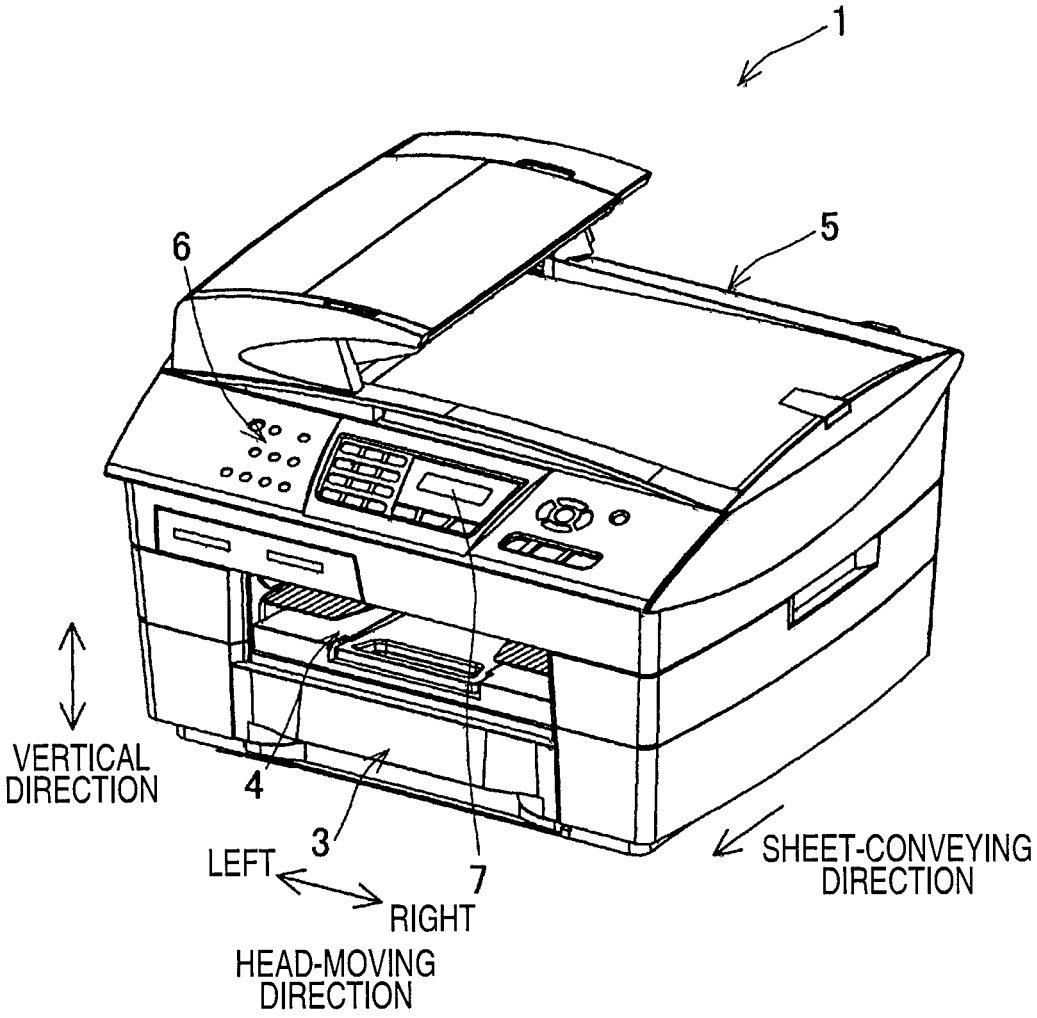
FIG. 1 is a perspective view schematically showing a configuration of an inkjet printer in an embodiment according to one or more aspects of the present invention.
Figure 2:
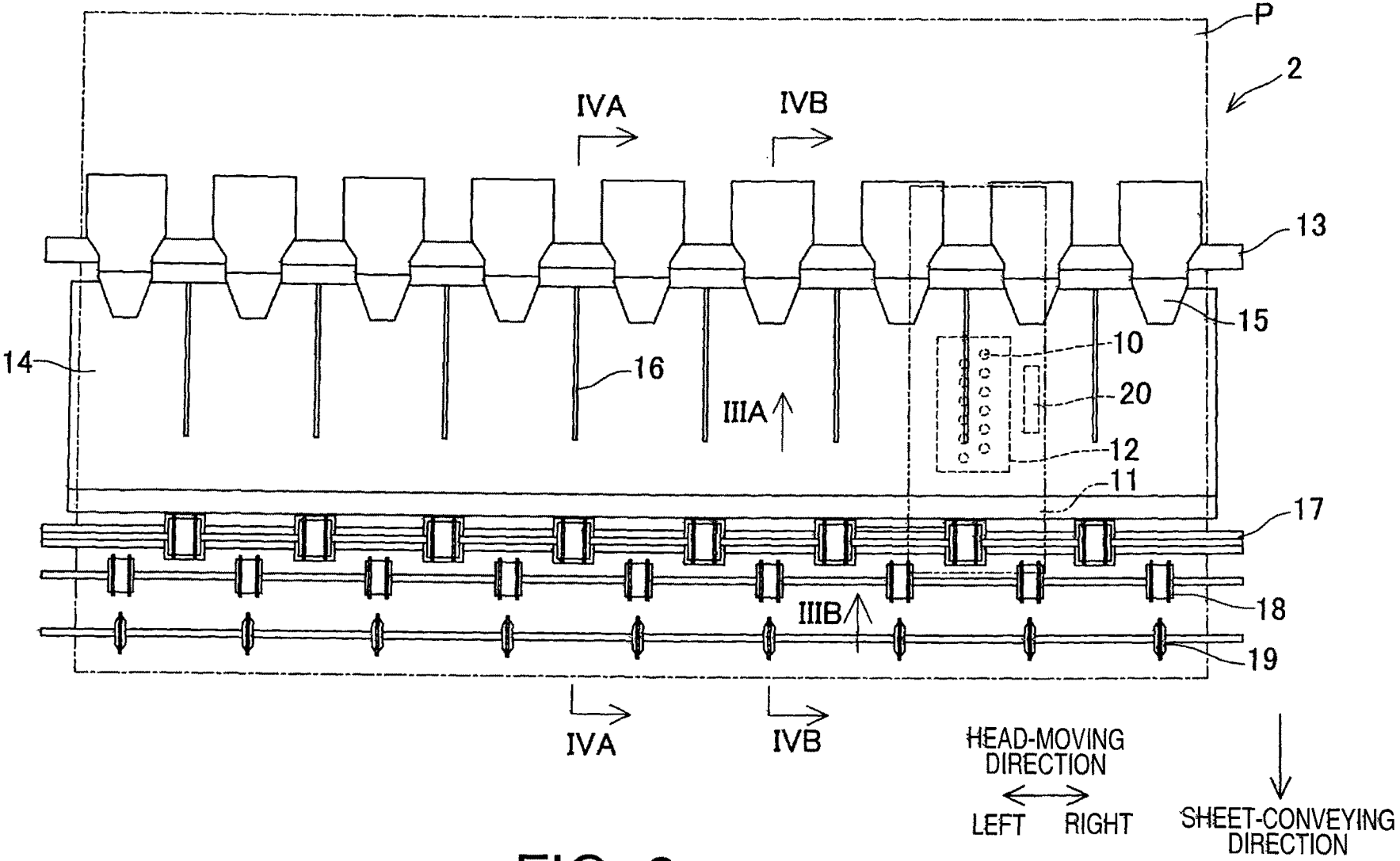
FIG. 2 is a top view of a printing unit of the inkjet printer in the embodiment according to one or more aspects of the present invention.
Figure 3A:
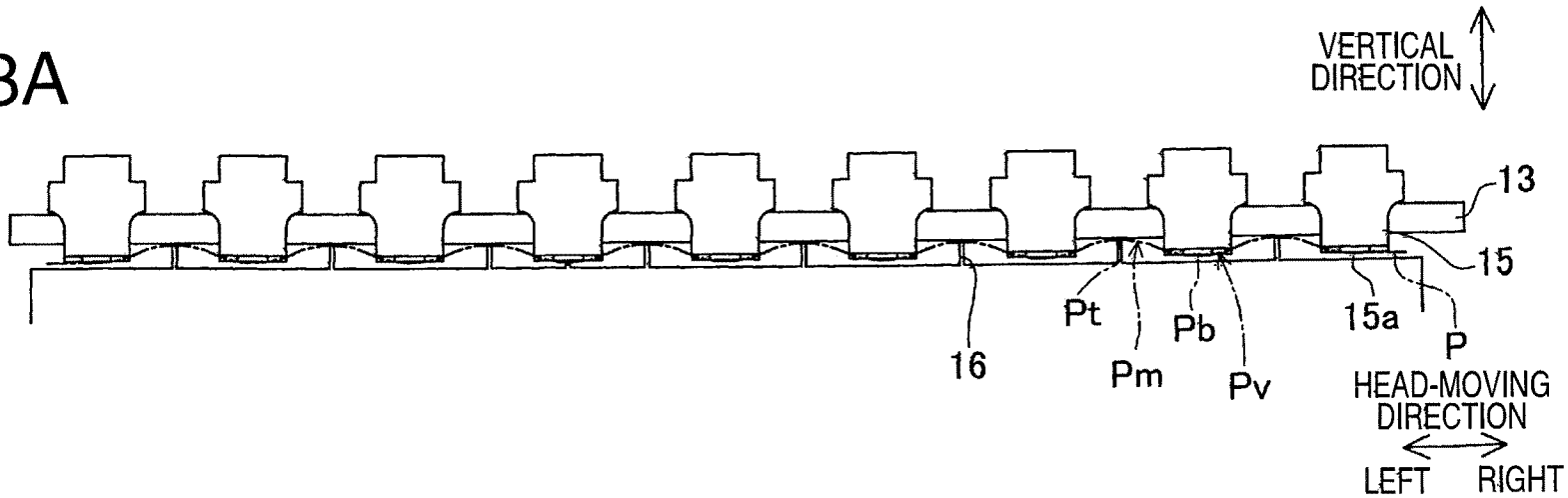

FIG. 3A schematically shows a part of the printing unit when viewed along an arrow IIIA shown in FIG. 2 in the embodiment according to one or more aspects of the present invention.

Figure 3B:
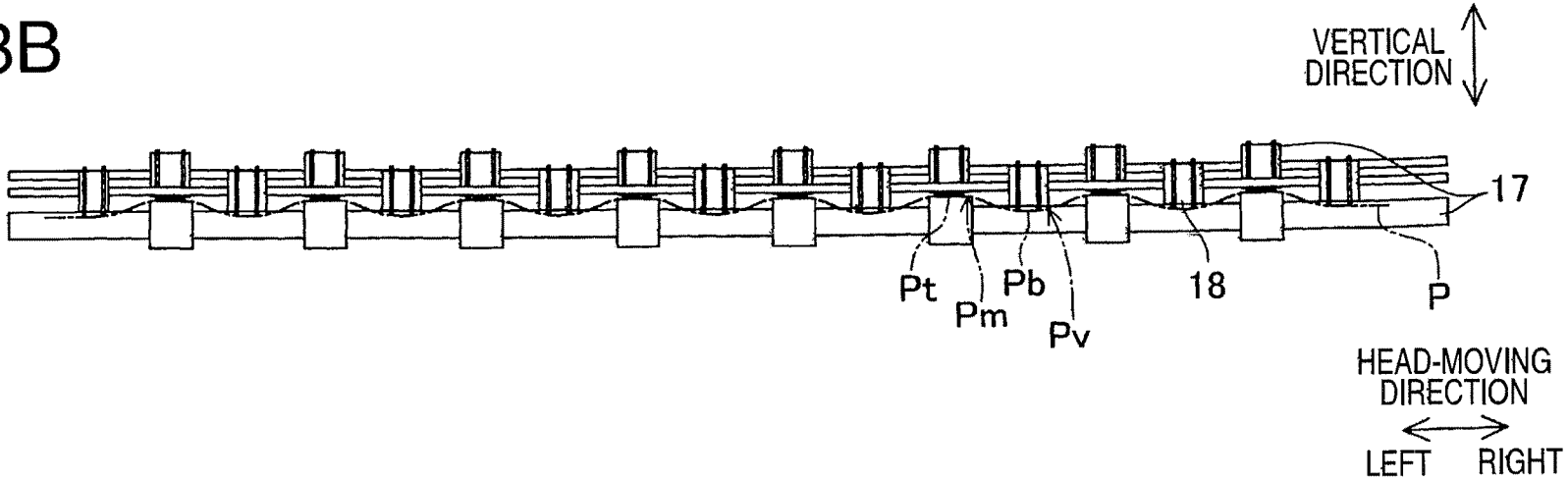

FIG. 3B schematically shows a part of the printing unit when viewed along an arrow IIIB shown in FIG. 2 in the embodiment according to one or more aspects of the present invention.

Figure 4A:
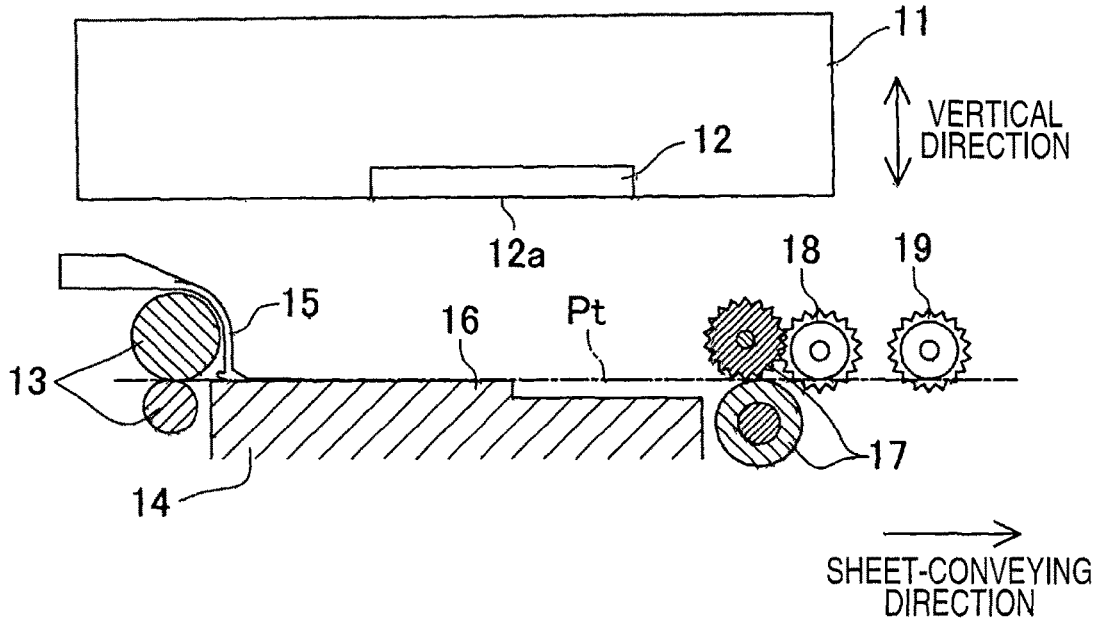

FIG. 4A is a cross-sectional view taken along a line IVA-IVA shown in FIG. 2 in the embodiment according to one or more aspects of the present invention.

Figure 4B:
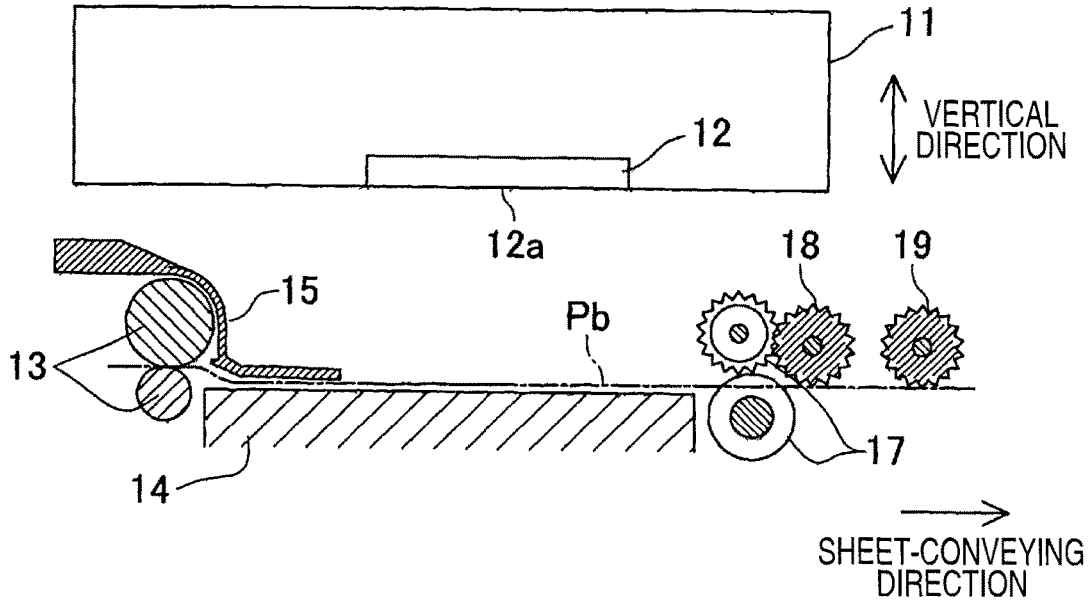

FIG. 4B is a cross-sectional view taken along a line IVB-IVB shown in FIG. 2 in the embodiment according to one or more aspects of the present invention.

Figure 5:
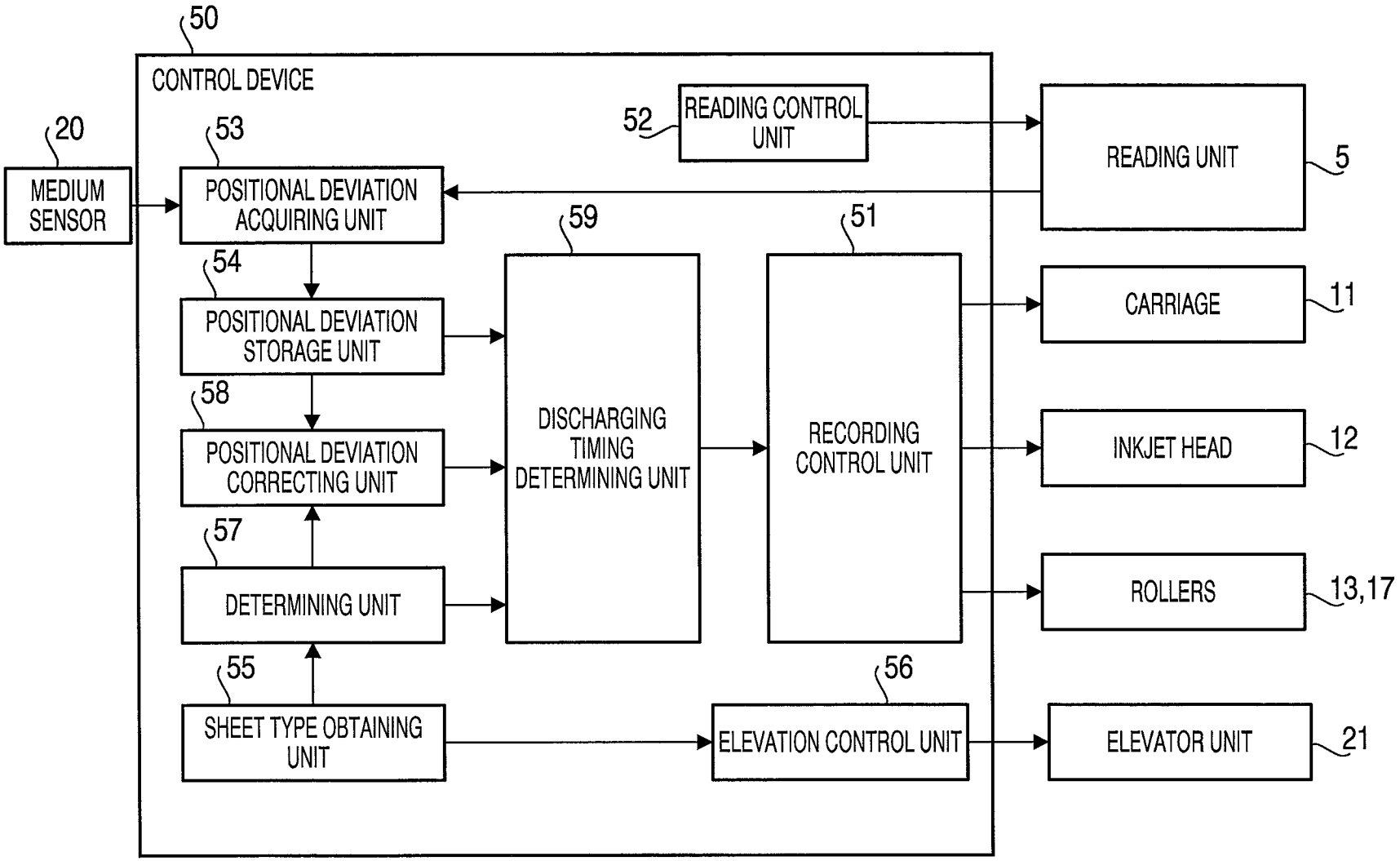

FIG. 5 is a functional block diagram of a control device of the inkjet printer in the embodiment according to one or more aspects of the present invention.

Figure 6:
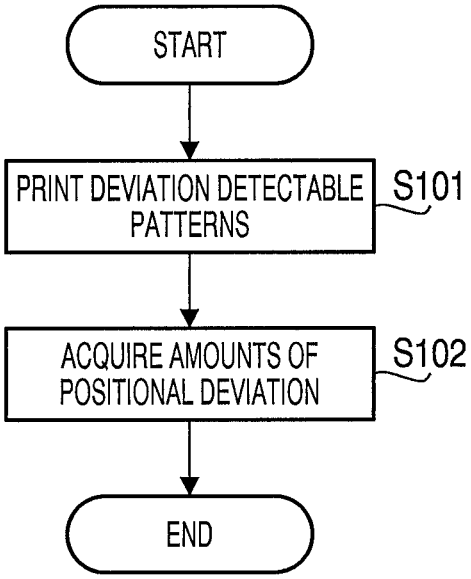

FIG. 6 is a flowchart to illustrate a process, which is to be executed prior to a printing operation, to determine ink discharging timing to discharge ink from nozzles in the inkjet printer in the embodiment according to one or more aspects of the present invention.

Figure 7A:
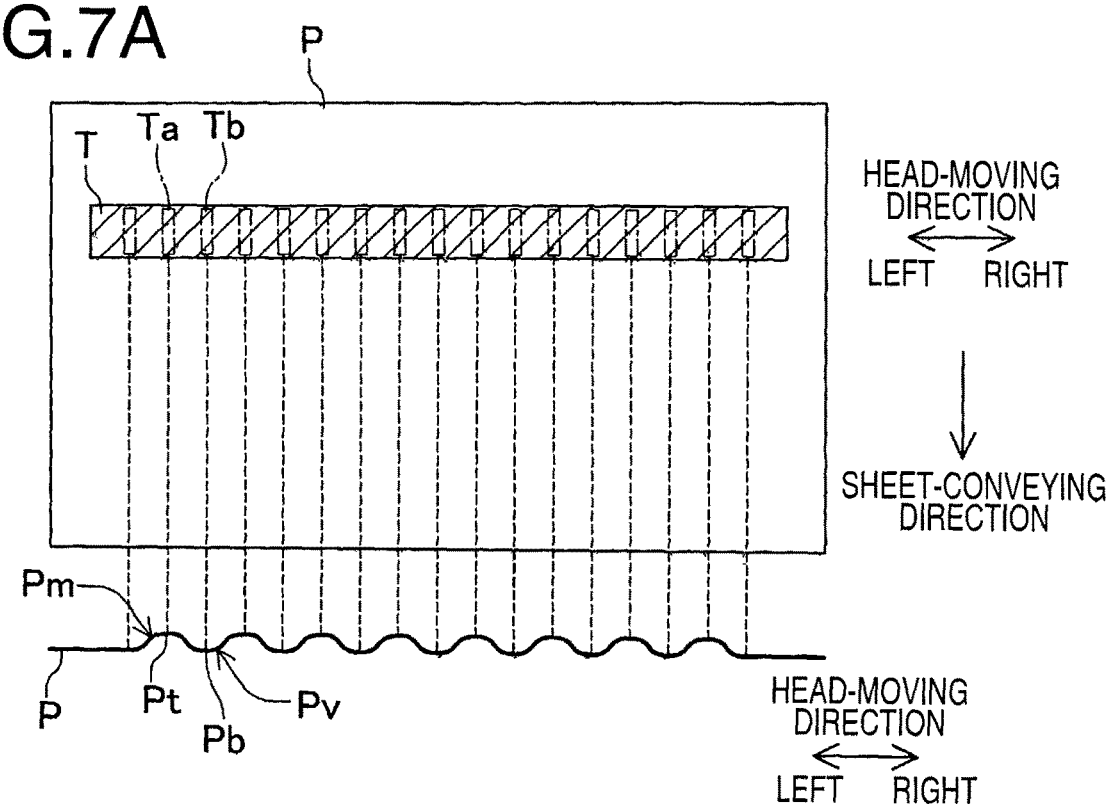

FIG. 7A shows deviation detectable patterns printed on a recording sheet and positions to read the deviation detectable patterns in the embodiment according to one or more aspects of the present invention.

Figure 7B:
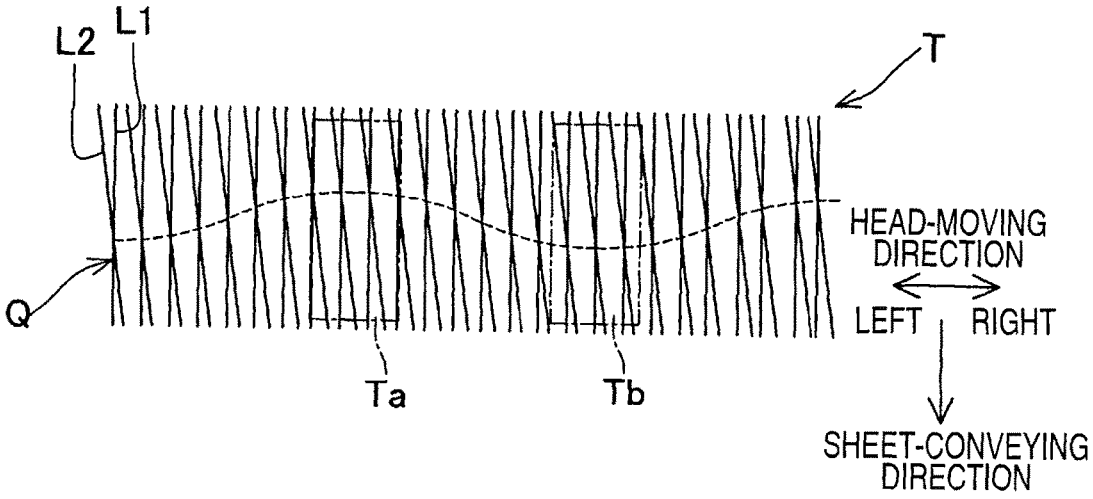

FIG. 7B is an enlarged view partially showing a part including a plurality of deviation detectable patterns printed on the recording sheet in the embodiment according to one or more aspects of the present invention.

Figure 8:
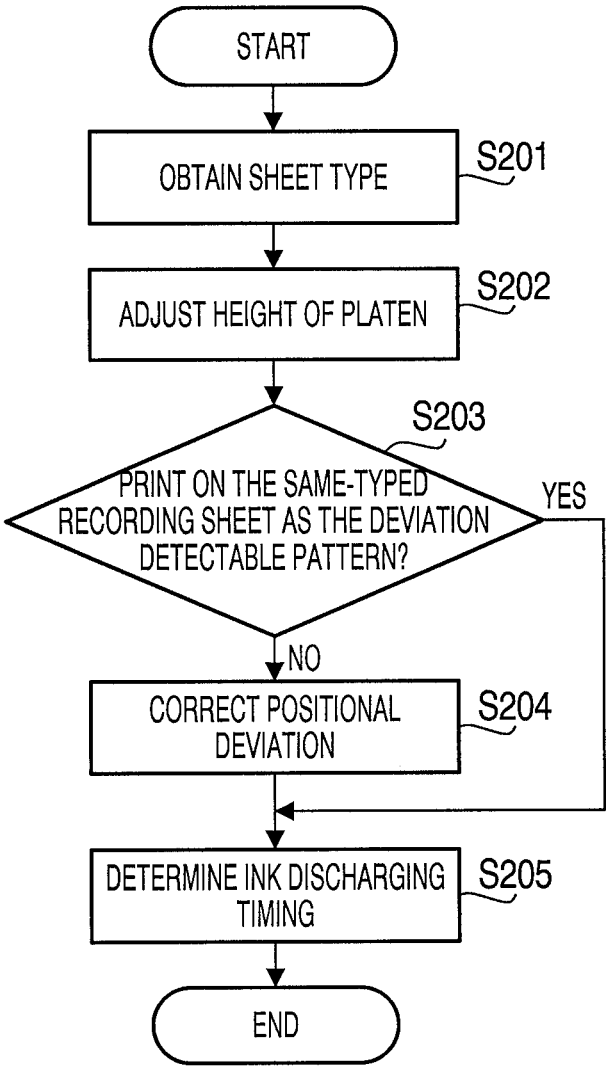

FIG. 8 is a flowchart to illustrate a process, which is to be executed during a printing operation, to determine ink discharging timing to discharge ink from nozzles in the inkjet printer in the embodiment according to one or more aspects of the present invention.

Figure 9A:
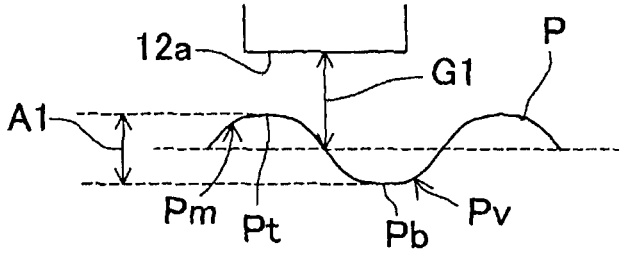
Figure 9B:
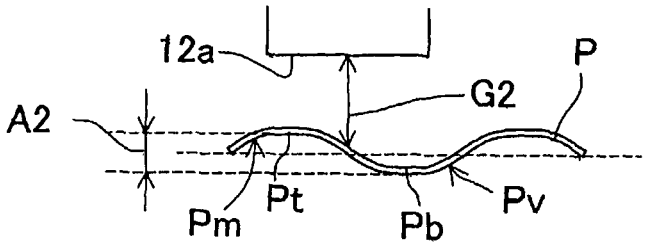

FIGS. 9A and 9B illustrate difference in amplitudes of ripples in a wave shape in the recording sheet and fluctuation of amounts of a gap between an ink discharging surface and the recording sheet due to difference in thickness in the inkjet printer in the embodiment according to one or more aspects of the present invention.

Figure 10A:
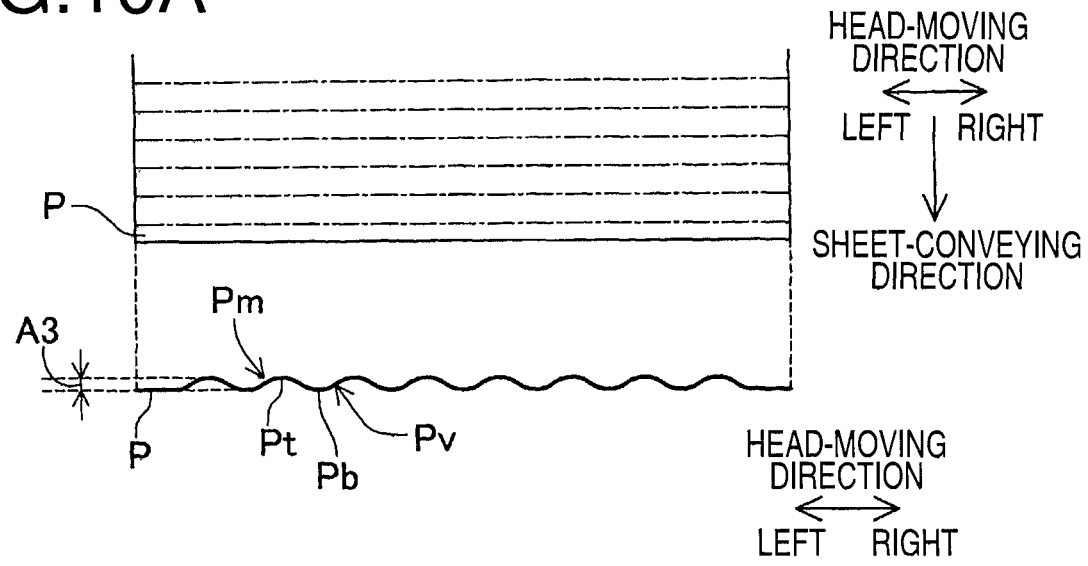
Figure 10B:
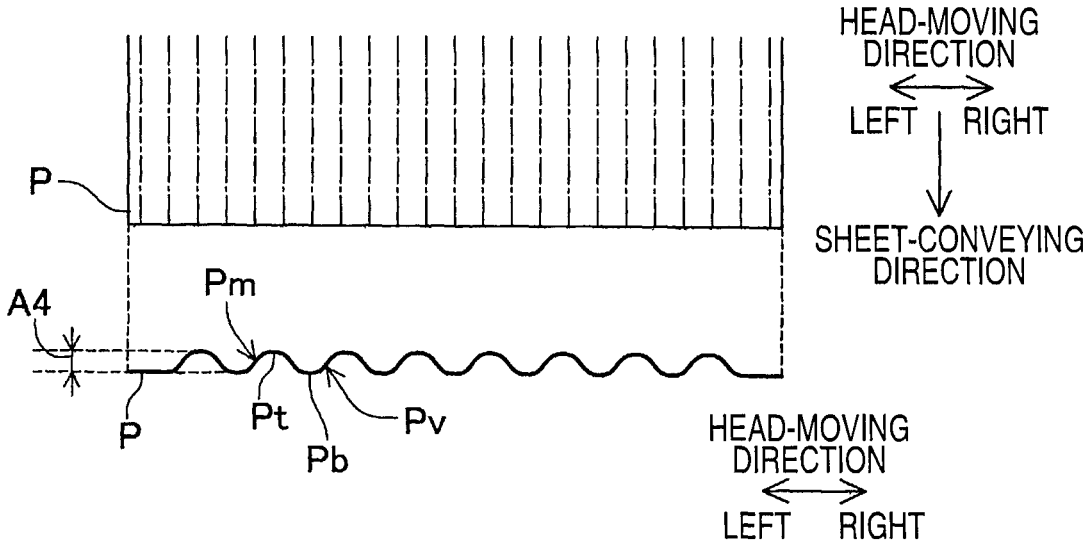

FIGS. 10A and 10B illustrate difference in amplitudes of ripples in the wave shape in the recording sheet due to difference in directions of fiber aligning in the recording sheet in the inkjet printer in the embodiment according to one or more aspects of the present invention.

Figure 11A:
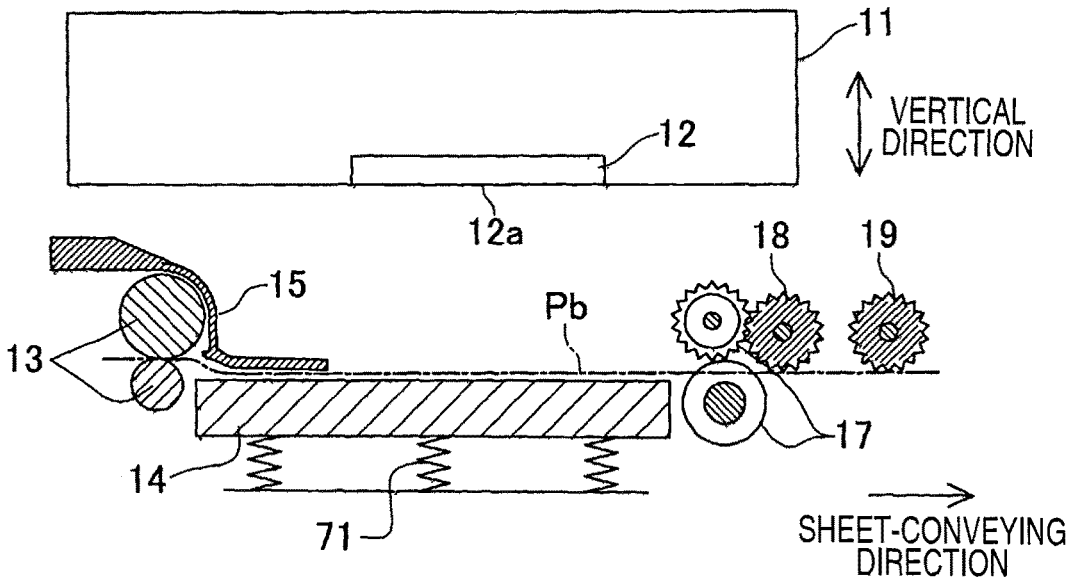

FIG. 11A is a cross-sectional view taken along the line IVA-IVA shown in FIG. 2 in a modification according to one or more aspects of the present invention.

Figure 11B:
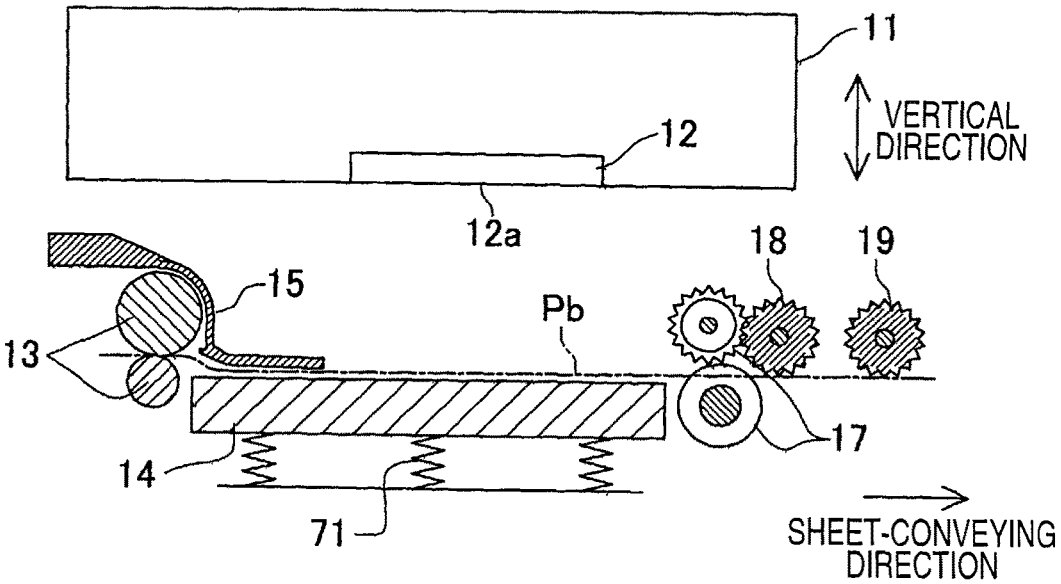

FIG. 11B is a cross-sectional view taken along the line IVB-IVB shown in FIG. 2 in the modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, embodiments according to aspects of the present invention will be described in detail with reference to the accompanying drawings.

An inkjet printer 1 of the embodiment is a multi-function peripheral having a plurality of functions such as a printing function to perform printing on a recording sheet P and an image reading function. The inkjet printer 1 includes a printing unit 2 (see FIG. 2), a sheet feeding unit 3, a sheet ejecting unit 4, a reading unit 5, an operation unit 6, and a display unit 7. Further, the inkjet printer 1 includes a control device 50 configured to control operations of the inkjet printer 1 (see FIG. 5).

The printing unit 2 is provided inside the inkjet printer 1. The printing unit 2 is configured to perform printing on the recording sheet P. A detailed configuration of the printing unit 2 will be described later. The sheet feeding unit 3 is configured to feed the recording sheet P to be printed by the printing unit 2. The sheet ejecting unit 4 is configured to eject the recording sheet P printed by the printing unit 2. The reading unit 5 is configured to be, for instance, an image scanner for reading images such as below-mentioned deviation detectable patterns Q for detecting displacement of ink droplets landing on the recording sheet P. The operation unit 6 is provided with buttons. A user is allowed to operate the inkjet printer 1 via the buttons of the operation unit 6. The display unit 7 is configured, for instance, as a liquid crystal display, to display information when the inkjet printer 1 is used.

Subsequently, the printing unit 2 will be described. As shown in FIGS. 2 to 4, the printing unit 2 includes a carriage 11, an inkjet head 12, a feed roller 13, a platen 14, a plurality of corrugated plates 15, a plurality of ribs 16, an ejection roller 17, and a plurality of corrugated spur wheels 18, 19, and a medium sensor 20. It is noted that, for the sake of easy visual understanding in FIG. 2, the carriage 11 is indicated by a dash-and-two-dots line, and portions disposed below the carriage 11 are indicated by solid lines.

The carriage 11 is configured to reciprocate on a guiderail (not shown) along a predetermined head-moving direction. The inkjet head 12 is mounted on the carriage 11 to be driven along with the carriage 11. The inkjet head 12 is configured to discharge ink from a plurality of nozzles 10 formed in an ink discharging surface 12*a* that is a lower surface of the inkjet head 12. It is noted that, the inkjet head 12 may be a line head extending over a whole length of a printable area in the head-moving direction. In this case, a head scanning mechanism such as the carriage 11 may not be provided, and a longitudinal (extending) direction of the line head may replace the head-moving direction.

The feed roller 13 includes two rollers configured to pinch therebetween the recording sheet P fed by the sheet feeding unit 3 and feed the recording sheet P in a predetermined sheet-conveying direction, which is orthogonal to the head-moving direction. The platen 14 is disposed to face the ink discharging surface 12*a*. The recording sheet P is fed by the feed roller 13, along an upper surface of the platen 14. The platen 14 is movable along a vertical direction by an elevator unit 21 (see FIG. 5).

The plurality of corrugated plates 15 are disposed to face an upper surface of an upstream end of the platen 14 along the sheet-conveying direction. The plurality of corrugated plates 15 are arranged at substantially even intervals along the head-moving direction. The recording sheet P, fed by the feed roller 13, passes between the platen 14 and the corrugated plates 15. At this time, pressing surfaces 15*a*, which are lower surfaces of the plurality of corrugated plates 15, press the recording sheet P from above.

Each of the plurality of ribs 16 is disposed between a corresponding two of mutually adjacent corrugated plates 15 along the head-moving direction, on the upper surface of the platen 14. The plurality of ribs 16 are arranged at substantially even intervals along the head-moving direction. Each rib 16 protrudes from the upper surface of the platen 14 up to a level higher than the pressing surfaces 15*a* of the corrugated plates 15. Each rib 16 extends from an upstream end of the platen 14 toward a downstream side along the sheet-conveying direction. Thereby, the recording sheet P on the platen 14 is supported from underneath by the plurality of ribs 16.

The ejection roller 17 includes two rollers configured to pinch therebetween portions of the recording sheet P that are located in the same positions as the plurality of ribs 16 along the head-moving direction and feed the recording sheet P toward the sheet ejecting unit 4. An upper one of the ejection rollers 17 is provided with spur wheels so as to prevent the ink attached onto the recording sheet P from being transferred to the upper ejection roller 17.

The plurality of corrugated spur wheels 18 are disposed substantially in the same positions as the corrugated plates 15 along the head-moving direction, at a downstream side relative to the ejection rollers 17 along the sheet-conveying direction. The plurality of corrugated spur wheels 19 are disposed substantially in the same positions as the corrugated plates 15 along the head-moving direction, at a downstream side relative to the corrugated spur wheels 18 in the sheet-conveying direction. In addition, the plurality of corrugated spur wheels 18 and 19 are placed at a level lower than a position where the ejection rollers 17 pinch the recording sheet P therebetween, along the vertical direction. The plurality of corrugated spur wheels 18 and 19 are configured to press the recording sheet P from above at the level. Further, the plurality of corrugated spur wheels 18 and 19 are not rollers having a smooth outer circumferential surface but a spur wheel. Therefore, it is possible to prevent the ink attached onto the recording sheet P from being transferred to the plurality of corrugated spur wheels 18 and 19.

Thus, the recording sheet P on the platen 14 is pressed from above by the plurality of corrugated plates 15 and the plurality of corrugated spur wheels 18 and 19, and is supported from below by the plurality of ribs 16. Thereby, as shown in FIG. 3, the recording sheet P on the platen 14 is bent and deformed in such a wave shape that mountain portions Pm protruding upward (i.e., toward the ink discharging surface 12*a*) and valley portions Pv recessed downward (i.e., in a direction opposite to the direction toward the ink discharging surface 12*a*) are alternately arranged along the head-moving direction. Further, each mountain portion Pm has a top portion Pt, protruding up to the highest position of the mountain portion Pm, which is located substantially in the same position as the center of the corresponding rib 16 in the head-moving direction. Each valley portion Pv has a bottom portion Pb, recessed down to the lowest position of the valley portion Pv, which is located substantially in the same position as the corresponding corrugated plate 15 and the corresponding corrugated spur wheels 18 and 19.

The medium sensor 20 is mounted on the carriage 11 and is configured to detect whether there is a recording sheet P on the platen 14. Specifically, for instance, the medium sensor 20 includes a light emitting element and a light receiving element. The medium sensor 20 emits light from the light emitting element toward the upper surface of the platen 14. The upper surface of the platen 14 is black. Therefore, when there is not a recording sheet P on the platen 14, the light emitted from the light emitting element is not reflected by the upper surface of the platen 14 or received by the light receiving element. Meanwhile, when there is a recording sheet P on the platen 14, the light emitted from the light emitting element is reflected by the recording sheet P and received by the light receiving element. Thus, the medium sensor 20 detects whether there is a recording sheet P on the platen 14, based on whether the light receiving element receives the light emitted from the light emitting element.

The printing unit 2 configured as above performs printing on the recording sheet P by discharging ink from the inkjet head 12 reciprocating together with the carriage 11 along the head-moving direction, while conveying the recording sheet P in the sheet-conveying direction by the feed rollers 13 and the ejection rollers 17.

Next, an explanation will be provided about the control device 50 for controlling the operations of the inkjet printer 1. The control device 50 includes a central processing unit (CPU), a read only memory (ROM), a random access memory (RAM), and control circuits. The control device 50 is configured to function as various elements such as a recording control unit 51, a reading control unit 52, a positional deviation acquiring unit 53, a positional deviation storage unit 54, a sheet type obtaining unit 55, an elevation control unit 56, a determining unit 57, a positional deviation correcting unit 58, and a discharging timing determining unit 59 (see FIG. 5).

The recording control unit 51 controls behaviors of the carriage 11, the inkjet head 12, the feed roller 13, and the ejection roller 17 when an image including deviation detectable patterns Q, which will be described later in detail, are printed. The reading controller 52 controls behaviors of the reading unit 5 when an image appearing on a sheet is read.

The positional deviation acquiring unit 53 acquires amounts of positional deviation of ink droplets landing on the top portions Pt and the bottom portions Pb of the recording sheet P, from the below-mentioned deviation detectable patterns Q read by the reading unit 5. It is noted that the amounts of positional deviation detected based on the deviation detectable patterns Q may be referred to as "gap information," which is information related to a gap between the ink discharging surface 12*a* and each of the top portions Pt and the bottom portions Pb. The positional deviation storage unit 54 stores the amounts of positional deviation detected from the deviation detectable patterns Q, i.e., the gap information, acquired by the positional deviation acquiring unit 53.

The sheet type obtaining unit 55 obtains a type of the recording sheet P to be used in the printing operation. The elevation control unit 55 controls behaviors of the elevator unit 21 to drive the platen 14 upward or downward according to the type (e.g., thickness) of the recording sheet P obtained by the sheet type obtaining unit 55.

The determining unit 57 determines whether a type of a recording sheet P to be used in the current printing operation and a type of a recording sheet P, on which the deviation detectable patterns Q are printed. The positional deviation correcting unit 58 corrects amounts of the positional deviation stored in the positional deviation storage unit 54, when necessary, according to the determination made by the determining unit 57. The discharging timing determining unit 56 determines ink discharging timing (moments) to discharge ink from the nozzles 10, based on the positional deviation amounts of ink droplets to land on the recording sheet P.

Subsequently, an explanation will be provided about a process to determine the ink discharging timing to discharge ink from the nozzles 10 in the inkjet printer 1, with reference to FIG. 6. In order to determine the ink discharging timing to discharge the ink droplets from the nozzles 10, the control device 50 executes a flow including steps S101, S102 shown in FIG. 6 prior to activating the printing operation. Further, during an active printing operation, the control device 50 executes a flow including steps S201-S205 shown in FIG. 8.

In S101, the control device 50, more specifically, the recording control unit 51, manipulates the printing unit 2 to print, on the recording sheet P, a patch T including a plurality of deviation detectable patterns Q. More specifically, for instance, the control device 50 controls the printing unit 2 to print a plurality of straight lines L1, which extend in parallel with the sheet-conveying direction and are arranged along the head-moving direction, by discharging ink from the nozzles 10 while moving the carriage 11 in one orientation (e.g., rightward) along the head-moving direction. After that, the control device 50 controls the printing unit 2 to print a plurality of straight lines L2, which are tilted with respect to the sheet feeding direction and intersect the plurality of straight lines L1, respectively, by discharging ink from the nozzles 10 while moving the carriage 11 in the other direction (e.g., leftward) along the head-moving direction. Thereby, as shown in FIG. 7B, the patch T including the plurality of deviation detectable patterns Q arranged along the head-moving direction is printed. Each positional deviation detecting pattern Q includes a combination of the mutually intersecting straight lines L1 and L2. At this time, ink droplets are discharged from the nozzles 10 in accordance with design-based ink discharging timing that is determined, for example, based on an assumption that the recording sheet P is not in the wave shape but flat. Alternatively, if the positional deviation amounts are adjusted preliminarily in advance, and the ink discharging timing is previously determined preliminarily in accordance with below-mentioned procedures, ink droplets may be discharged from the nozzles 10 in accordance with the preliminarily determined ink discharging timing.

Next, in S102, the control device 50, in particular, the reading control unit 52, controls the reading unit 5 to read the printed deviation detectable patterns Q, and the control device 50, in particular, the positional deviation acquiring unit 53, acquires the positional deviation amounts of ink droplets landing on the top portions Pt and the bottom portions Pb. The acquired positional deviation amounts, i.e., the gap information, are stored in the positional deviation storage unit 54 in association with the type of the recording sheet P, on which the deviation detectable patterns Q are printed.

More specifically, for example, when the deviation detectable patterns Q as shown in FIGS. 7A and 7B are printed in a situation where there is a deviation between the ink landing position in the rightward movement of the carriage 11 and the ink landing position in the leftward movement of the carriage 11, the straight line L1 and the straight line L2 of each deviation detectable pattern Q are printed to be displaced with respect to each other along the head-moving direction. Therefore, the straight line L1 and the straight line L2 intersect each other in a position displaced from centers of the straight lines L1 and L2 along the sheet-conveying direction depending on the positional deviation amount with respect to the ink landing positions along the head-moving direction. Further, when the reading unit 5 reads each deviation detectable pattern Q, the reading unit 5 detects a higher degree of brightness at the intersection of the straight lines L1 and L2 than the brightness at any other portion of the read deviation detectable pattern Q. Accordingly, by reading each individual deviation detectable pattern Q and acquiring a position with the highest degree of brightness within the read deviation detectable pattern Q, it is possible to detect the position of the intersection of the straight lines L1 and L2.

In the embodiment, the control device 50, more specifically, the reading control unit 52, controls the reading unit 5 to read deviation detectable patterns Q, of the plurality of deviation detectable patterns Q, in a section Ta and a section Tb that respectively correspond to each top portion Pt and each bottom portion Pb within the patch T. Further, the control device 50, more specifically, the positional deviation acquiring unit 53, acquires the position with the highest degree of brightness within each individual read deviation detectable pattern Q, so as to acquire the positional deviation amounts of ink droplets landing on the plurality of top portions Pt and the plurality of bottom portions Pb.

As described above, in S102, the control device 50 controls the reading unit 5 to read only the deviation detectable patterns Q in the sections Ta and the sections Tb. Therefore, in S101, the control device 50 may control the printing unit 2 to print at least the deviation detectable patterns Q in the sections Ta and the sections Tb.

Further, when a printing operation is activated, in S201, the control device 50, more specifically, the sheet type obtaining unit 55, obtains the type of a current recording sheet P to be used in the current printing operation. For example, when a user inputs a print job, the user may select a type (e.g., regular printing paper, gloss paper, etc.) of the current recording sheet P to be used and input the selection in the inkjet printer 1 via the operation unit 6 or a PC (not shown) connected to the inkjet printer 1. The sheet type obtaining unit 55 may obtain information concerning the selection and identify the type of the current recording sheet P based on the obtained information. For another example, the inkjet printer 1 may be equipped with a thickness sensor, which may detect thickness of the recording sheet P, and the detected thickness of the current recording sheet P may be obtained by the sheet type obtaining unit 55 to identify the type of the recording sheet P.

In S202, the control device 50, more specifically, the elevation control unit 56, manipulates the elevator unit 21 to adjust height of the platen 14 according to the type (i.e., thickness) of the current recording sheet P obtained in S201. If the upper surface of the platen 14 is maintained at a same height level regardless of thickness of the recording sheet P, and an amount of clearance between the platen 14 and the corrugated plate 15 is maintained steady, stress to be applied to the recording sheet P passing through the clearance may vary depending on the thickness of the recording sheet P. More specifically, when the amount of clearance is steady, a thicker recording sheet P is subject to greater stress in the position between the platen 14 and the corrugated plates 15. Therefore, in order to maintain the levels of the stress equalized between the different-typed recording sheets P, the level of the platen 14 is adjusted depending on the thickness of the recording sheet P to be used. More specifically, the thicker the recording sheet P is, at the lower level the platen is placed.

In S203, the control device 50, more specifically, the determining unit 57 judges whether the type of the current recording sheet P obtained by the sheet type obtaining unit 55 is the same as the type of the former recording sheet P, on which the deviation detectable patterns Q are printed. The identity of the current and former recording sheets P may be determined by that, for example, when the deviation detectable patterns Q are printed by the printing unit 2 in S101, the type of the former recording sheet P to be used may be obtained by the sheet type obtaining unit 55, and the obtained sheet type may be stored in, for example, a RAM in the control device 50. Thereafter, in S203, the type of the current recording sheet P obtained in S201 and the type of the former recording sheet P stored in the RAM may be compared to judge whether these types of the recording sheets P are the same or not. When the determining unit 57 determines that the type of the current recording sheet P obtained by the sheet type obtaining unit 55 is the same as the type of the former recording sheet P, on which the deviation detectable patterns Q are printed (S203: YES), the flow proceeds to S205.

Meanwhile, when the determining unit determines that the type of the current recording sheet P is different from the type of the former recording sheet P (S203: NO), in S204, the positional deviation correcting unit 58 modifies the amounts of positional deviation, which are obtained in S102, for the type of the current recording sheet P obtained in S201.

As has been described above, in the inkjet printer 1 according to the present embodiment, in which the recording sheet P is rippled in the wave shape with the mountain portions Pm and the valley portions Pv being arranged alternately along the head-moving direction, when the inkjet head 12 discharges the ink to print an image, the amounts of the gap between the ink discharging surface 2*a* and the rippled recording sheet P tend to vary depending on the type of the recording sheet P.

For example, when a relatively flexible recording sheet P with lower rigidity is used, as shown in FIG. 9A, the recording sheet P can be deformed more easily, and a level of amplitude A1 between the tops Pt of the mountain portions Pm and the bottoms Pb of the valley portions Pv becomes greater. Meanwhile, when a recording sheet P with higher rigidity, such as a glossy paper, as shown in FIG. 9B, the recording sheet P may not be deformed easily, and a level of amplitude A2 between the tops Pt of the mountain portions Pm and the bottoms Pb of the valley portions Pv becomes smaller than the level of amplitude A1. Thus, the amounts of the gap between the ink discharging surface 12*a* and each position in the recording sheet P may vary depending on rigidity of the recording sheet P.

Further, if the level of the platen 14 is constant, when the recording sheet P has greater thickness, the recording sheet P is set to have the upper surface thereof in a higher position to be closer to the ink discharging surface 12*a*. For example, a gap G1 shown in FIG. 9A represents an average level of the heights of the rippled recording sheet P when the recording sheet P is relatively thin (e.g., regular printing paper). Meanwhile, a gap G2 shown in FIG. 9B represents an average level of the heights of the rippled recording sheet P when the recording sheet P is relatively thick (e.g., glossy paper). When the gap G1 and the gap G2 are compared, it is to be noted that the gap G2 is smaller than the gap G1 for the thickness of the recording sheet P. Thus, the amounts of the gap between the ink discharging surface 12*a* and each position in the recording sheet P vary depending on thickness of the recording sheet P.

Furthermore, in many cases, sheets of paper contain pulp fibers, which extend to align along either a longitudinal direction of the sheets or a direction orthogonal to the longitudinal direction. When the recording sheet P with such fibers aligned along one direction is used in the inkjet printer 1, the recording sheet P is placed in the inkjet printer 1 with the fibers aligning along either the head-moving direction (see FIG. 10A) or the sheet-conveying direction (see FIG. 10B). In the present embodiment, a posture of the recording sheet P with the fibers aligned along the head-moving direction is referred to as a first posture, and a posture of the recording sheet P with the fibers aligned along the sheet-conveying direction is referred to as a second posture. In FIGS. 10A and 10B, the dash-and-dot lines represent the orientation of the aligned fibers in the recording sheet P.

When the recording sheet P in the first posture is deformed into the rippled form, the recording sheet P is curved along a direction, in which each of the fibers is bent by the curvature of the ripples. Therefore, when in the rippled shape, the recording sheet P is subject to greater reaction force against the bending force from the fibers. On the other hand, when the recording sheet in the second posture is deformed into the rippled form, the recording sheet P is curved along a direction, which is orthogonal to the fiber-bending direction. In other words, the fibers are less likely to be bent by the curvature of the ripples. Therefore, when in the rippled shape, the recording sheet P is subject to smaller reaction force against the smaller bending force from the fibers. Thus, a level of amplitude A3 in the ripples of the recording sheet P in the first posture is smaller than a level of amplitude A4 in the ripples of the recording sheet P in the second posture.

Moreover, when the ink droplets land on the recording sheet P, the portions exposed to the ink droplets become wet and swell to be deformed. Thus, heights of the swelling ink-landing portions in the recording sheet P are changed from heights of dry portions. In this respect, the recording sheet P is deformed along the direction orthogonal to the extending direction of the fibers.

Therefore, when the fibers extend in parallel with the head-moving direction (see FIG. 10A), the wet recording sheet P swells to deform along the sheet-conveying direction, which is orthogonal to the head-moving direction and orthogonal to the wave shape of the recording sheet P. On the other hand, when the fibers extend orthogonally to the head-moving direction (see FIG. 10B), the wet recording sheet P swells to deform along the head-moving direction, along which the recording sheet P ripples. Further, when a ratio of areas, in which the ink droplets land on the recording sheet P, with respect to an entire surface on the recording sheet P, (so-called "ink duty") is greater, an amount of deformation in the recording sheet P due to the swell becomes greater. Thus, the amounts of the gap between the ink discharging surface 12*a* and each position in the recording sheet P vary depending on the posture of the recording sheet P and the ratio of the ink-landing areas in the recording sheet P.

Meanwhile, amounts of positional deviation appearing in the deviation detectable patterns Q printed in S101 on the former recording sheet P will correspond to amounts of positional deviation printed on a current recording sheet P, when the sheet type of the current recording sheet P is the same as the sheet type of the former recording sheet P used in S101.

Therefore, in S204, when it is determined that the type of the current recording sheet P to be used in the current printing operation is different from the type of the former recording sheet P used to print the deviation detectable patterns in S101, the control device 50, more specifically, the positional deviation correcting unit 58, corrects the amounts of positional deviation obtained in S102 with respect to the type of the current recording sheet P. In particular, the amounts of positional deviation are adjusted in consideration of various factors including variation in the amplitude of the ripples in the recording sheet P due to the rigidity difference, variation in the heights of the upper surface of the recording sheet P due to the thickness difference, the orientations of the fibers in the recording sheet P, and the ink duty. In the present embodiment, however, the level of the platen 14 has been adjusted in S202. Therefore, amounts to correct the positional deviation in consideration of the variation in heights of the upper surface of the recording sheet P due to the thickness difference may be smaller than amounts of correction in a case where the level of the platen 14 is not adjusted in S202. The information concerning these factors to be considered may be determined based on the type of the recording sheet P obtained in S201. Further, information concerning the postures of the recording sheet P may also be obtained as well as the information concerning the sheet type in, for example, S201. For example, the posture of the recording sheet P usable in the inkjet printer 1 may be stored in a storage unit (not shown) in the control device 50 in association with usable types of the recording sheets P, and when the user inputs the print job and selects the sheet type to be used, the posture of the recording sheet P may be obtained by the sheet type obtaining unit 55 along with the information concerning the sheet type.

The amounts of correction in consideration of the variation of amplitude in the ripples in the recording sheet P and the variation of the heights of the upper surface of the recording sheet P may be acquired, for example, in a following method. That is, when the amount of positional deviation acquired in S102 is represented by Y, and an amount of positional deviation after being corrected is represented by Y', Y' is obtained by a formula, $Y'=a \cdot Y+b$. In this respect, "a" represents a value, which is set depending on a ratio of amplitude in the ripples in the current recording sheet P with respect to the amplitude in the ripples in the former recording sheet P. Meanwhile, "b" represents a value, which is set depending on a ratio of an amount of the gap between the ink discharging surface 12*a* and the current recording sheet P with respect to the amount of the gap between the ink discharging surface 12*a* and the former recording sheet P.

In S205, the control device 50, more specifically, the discharging timing determining unit 56, determines the timing to discharge the ink droplets from the nozzles 10 in the printing operation in consideration of the amounts of positional deviation of the ink droplets. In particular, when the sheet type of the current recording sheet P is the same as the sheet type of the former recording sheet P, the timing to discharge the ink droplets from the nozzles 10 is determined according to the amounts of positional deviation stored in the positional deviation storage unit 54 in S102. On the other hand, when the sheet type of the current recording sheet P is different from the sheet type of the former recording sheet P, the timing to discharge the ink droplets from the nozzles 10 is determined according to the corrected amounts of positional deviation, which is obtained in S204.

In this respect, it is noted that, in S102, the control device 50 acquires only the positional deviation amounts on the top portions Pt and the bottom portions Pb. In this respect, in the embodiment, the recording sheet P is deformed in the ripples with the top portions Pt and the bottom portions Pb alternately arranged, by the plurality of corrugated plates 15, the plurality of ribs 16, and the plurality of corrugated spur wheels 18 and 19. Therefore, by obtaining the positional deviation amounts on the top portions Pt and the bottom portions Pb, it is possible to estimate positional deviation amounts on portions of the mountain portions Pm other than the top portions Pt and on portions of the valley portions Pv other than the bottom portions Pb.

Accordingly, the control device 50 determines the ink discharging timing to discharge ink onto the portions of the mountain portions Pm other than the top portions Pt and onto the portions of the valley portions Pv other than the bottom portions Pb, based on the estimated positional deviation amounts.

It is noted that, in S102, the control device 50 may read the deviation detectable patterns Q on the portions of the mountain portions Pm other than the top portions Pt and the portions of the valley portions Pv other than the bottom portions Pb, and may obtain positional deviation amounts from the read deviation detectable patterns Q. Further, the control device 50 may determine the ink discharging timing to discharge ink from the nozzles 10, based on the obtained positional deviation amounts. However, in this case, the quantity of the positional deviation amounts obtained by the positional deviation acquiring unit 53 and stored in the positional deviation storage unit 54 is large, and it requires a large capacity of RAM for the control device 50.

According to the embodiment described above, when the recording sheet P is deformed in the wave shape with the plurality of mountain portions Pm and the plurality of valley portions Pv alternately arranged along the head-moving direction, amounts of the gap between the ink discharging surface 12*a* and the recording sheet P vary depending on portions (areas) on the recording sheet P. Further, when the amounts of the gap between the ink discharging surface 12*a* and the recording sheet P vary depending on portions (areas) on the recording sheet P, there are differences between the positional deviation amounts caused in the rightward movement of the carriage 11 and the positional deviation amounts caused in the leftward movement of the carriage 11. Therefore, in order to place ink droplets in appropriate positions on such a wave-shaped recording sheet P, it is required to determine the ink discharge timing to discharge the ink droplets from the nozzles 10 depending on the amount of the gap at each portion on the recording sheet P.

Thus, in the embodiment, by printing the deviation detectable patterns Q on the wave-shaped recording sheet P and reading the printed deviation detectable patterns Q, the control device 50 acquires the amounts of positional deviation on the top portions Pt and the bottom portions Pb.

In this respect, however, the amounts of the gap between the ink discharging surface 12*a* and the recording sheet P vary depending on the type of the recording sheet P. Therefore, in S205, if the control device 50 determines the ink discharging timing to discharge ink from the nozzles 10 in the printing operation based on the amounts of positional deviation acquired in S102 but regardless of the sheet type of the recording sheet P, actual ink-landing positions on the current recording sheet P are displaced from the ink-landing positions on the former recording sheet P, which is different in the sheet type from the current recording sheet P. Thus, quality of the printed image may be lowered.

Meanwhile, in the embodiment, when an image is printed on the current recording sheet P of a different sheet type being different from the sheet type of the former recording sheet, on which the deviation detectable patterns Q are printed, the amounts of the positional deviation acquired from the deviation detectable patterns Q are corrected according to the type of the current recording sheet P. Thus, amounts of positional deviation corrected for the sheet type of the current recording sheet P can be acquired. In other words, preferably corrected amounts of positional deviation for the current recording sheet P can be acquired even when the sheet types are different. Therefore, in S204, the ink discharge timing to discharge the ink droplets from the nozzles 10 for the current recording sheet P can be correctly determined.

Further, in S204, the ink discharge timing is determined in consideration of variation in the amplitude of the ripples in the recording sheet P due to the rigidity difference, variation in the heights of the upper surface of the recording sheet P due to the thickness difference, the orientations of the fibers in the recording sheet P, and the ink duty. Therefore, the amounts of positional deviation may be even more accurately corrected.

Furthermore, in the embodiment described above, the platen 14 is movable vertically to be uplifted or lowered, and in S202, the platen 14 is moved upward or downward to adjust the level of the upper surface of the recording sheet P depending on the thickness of the current recording sheet P. Therefore, by the adjustment of the vertical position of the platen 14, fluctuation of the gap amounts between the ink discharging surface 12*a* and each position in the recording sheet P due to the difference in thickness of the recording sheet P may be reduced or offset.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

In the aforementioned embodiment, the platen 14 is movable in the vertical direction by the elevator unit 20, and thereby, the stress to be applied to the recording sheet P passing through the clearance between the platen 14 and the corrugated plates 15 is equalized among the recording sheets P of different types. However, the stress may not necessarily be equalized by the elevator unit 20.

For example, as shown in FIG. 11, the platen 14 may be supported to be movable in the vertical direction and urged upwardly by springs 71 at the same time. In this regard, when the recording sheet P passes through the clearance between the platen 14 and the corrugated plates 15, the recording sheet P presses the platen 14 downward against the urging force from the springs 71. The amount for the platen to be pressed is greater as the recording sheet P is thicker. In this configuration, too, the stress to be applied to the recording sheet P passing through the clearance between the platen 14 and the corrugated plates 15 is equalized among the recording sheets P of different thickness.

For another example, the platen 14 may not necessarily be movable in the vertical direction but may be fixed at a level. Even in this configuration, the amounts of positional deviation may still be corrected in S204 according to the thickness of the recording sheet P, and the corrected amounts of positional deviation may be acquired. Further, the platen 14 may be fixed at a level, and the inkjet head 12 may be moved in the vertical direction with respect to the recording sheet P placed on the platen 14 to correct the positional deviation. Furthermore, both the platen 14 and the inkjet head 12 may be moved in cooperation with each other in the vertical direction to correct the positional deviation.

For another example, unlike S204 in the aforementioned embodiment, the amounts of positional deviation may not necessarily be corrected in consideration of all of the variation in the amplitude of the ripples in the recording sheet P due to the rigidity difference, the variation in the heights of the upper surface of the recording sheet P due to the thickness difference, the orientations of the fibers in the recording sheet P, and the ink duty.

For example, the amounts of positional deviation may be corrected solely in consideration of the orientations of the fibers in the recording sheet P, and the ink duty may not necessarily be considered. For another example, solely the orientations of the fibers in the recording sheet P may be omitted from the consideration.

In S202 in the aforementioned embodiment, fluctuation of the gap amounts between the ink discharging surface 12*a* and each position in the recording sheet P due to the difference in thickness of the recording sheet P is reduced or offset by the adjustment of the vertical position of the platen 14. Therefore, when the amounts of positional deviation are corrected, variation in the levels of the upper surface of the recording sheet P due to the difference in thickness of the recording sheet P may not be taken into consideration.

For another example, the amounts of positional deviation may be corrected in consideration of factors, which may vary depending on rigidity of the recording sheet P, other than the amplitude of the ripples. Further, the amounts of positional deviation may be corrected in consideration of other information concerning rigidity of the recording sheet, such as rigidity values of the recording sheet P.

Further, the amounts of positional deviation may be corrected in consideration of other various factors, which may vary depending on the type of the recording sheet P and may affect the amounts of the gap between the ink discharging surface 12*a* and each position in the rippled recording sheet, but other than rigidity or thickness of the recording sheet P, or orientations of the fibers.

In the aforementioned embodiment, the reading unit 5 of the inkjet printer 1 reads the printed deviation detectable patterns Q so as to acquire the positional deviation amounts on the top portions Pt and the bottom portions Pb. However, the configuration for reading the printed deviation detectable patterns Q to acquire and correct as needed the positional deviation amounts is not limited to the above configuration.

For example, the medium sensor 20 may read the deviation detectable patterns Q printed on the recording sheet P. In this case, when light emitted by the light emitting element of the medium sensor 20 is incident onto the straight line L1 and L2 of a deviation detectable pattern Q, the light is not reflected thereat or received by the light receiving element. Meanwhile, when the light emitted by the light emitting element of the medium sensor 20 is incident onto a portion of the recording sheet P without any straight line L1 or L2 printed thereon, the light is reflected thereat and received by the light receiving element. Accordingly, it is possible to recognize presence of the straight lines L1 and L2 based on a determination as to whether the light receiving element of the medium sensor 20 receives the light emitted by the light emitting element. Thereby, it is possible to acquire a positional deviation amount from positional information on the intersection of the straight lines L1 and L2.

Alternatively, for instance, in a process for manufacturing the inkjet printer 1, a device different from the inkjet printer 1 may read the deviation detectable patterns Q printed by the inkjet printer 1 to acquire the positional deviation amounts on the top portions Pt and the bottom portions Pb. In this case, for instance, the positional deviation amounts acquired or corrected by the device different from the inkjet printer 1 may be written into the positional deviation storage unit 54, and the positional deviation correcting unit 58 may correct the positional deviation amounts having been written in the positional deviation storage unit 54. Further, in this case, the inkjet printer 1 may not necessarily be a multi-function peripheral having the reading unit 5. The inkjet printer 1 may be provided with only a printing function.

In the aforementioned embodiment, the control device 50 controls the reading unit 5 to read the patch T including the plurality of deviation detectable patterns Q so as to acquire the positional deviation amounts. However, for instance, the positional deviation amounts may be acquired by a following alternative method. The method may include printing a plurality of patches T with respective ink discharging timings gradually differing by a predetermined time amount. The method may further include making the user select one of the plurality of patches T that includes a printed deviation detectable pattern Q with the straight lines L1 and L2 intersecting each other in a position closest to the center of the straight lines L1 and L2 along the sheet conveying direction (i.e., making the user select a patch T that includes a deviation detectable pattern Q printed with the smallest positional deviation amount) in comparison with the other patches T, with respect to each of the top portions Pt and the bottom portions Pb.

In the aforementioned embodiment, the control device 50 controls the printing unit 2 to print the deviation detectable patterns Q, each of which has the straight lines L1 and L2 intersecting each other, by discharging ink from the nozzles 10 while moving the carriage 11 rightward along the head-moving direction to print the straight line L1 and discharging ink from the nozzles 10 while moving the carriage 11 leftward along the head-moving direction to print the straight line L2.

However, for instance, the deviation detectable patterns may be printed in a following alternative method. The method may include printing a plurality of straight lines L2 on a recording sheet P, on which a plurality of lines similar to the straight lines L1 are formed in advance, by discharging ink from the nozzles 10 while moving the carriage 11 rightward or leftward along the head-moving direction, so as to form deviation detectable patterns, each of which has the ready-formed straight line and a printed straight line L2 intersecting each other. Even in this case, by reading the formed deviation detectable patterns, it is possible to acquire a positional deviation amount, relative to a reference position, of an ink droplet landing on each of the top portions Pt and the bottom portions Pb.

Further, the deviation detectable pattern is not limited to a pattern with two straight lines intersecting each other. The deviation detectable pattern may be another pattern configured to provide a printed result that varies depending on the positional deviation amount.

In the aforementioned embodiment, the ink discharging timing to discharge ink from the nozzles 10 is determined based on the positional deviation amounts on the top portions Pt and the bottom portions Pb. However, for instance, the ink discharging timing may be determined based on positional deviation values on portions of the mountain portions Pm other than the top portions Pt and portions of the valley portions Pv other than the bottom portions Pb.

In the aforementioned embodiment, by printing the deviation detectable patterns Q and reading the printed deviation detectable patterns Q, the positional deviation amounts on the top portions Pt and the bottom portions Pb are acquired as gap information related to a gap between the ink discharging surface 12*a* and each portion on the recording sheet P. However, different information related to the gap between the ink discharging surface 12*a* and each portion on the recording sheet P may be acquired. Further, the gap between the ink discharging surface 12*a* and each portion on the recording sheet P may be acquired by directly measuring the gap.

What is claimed is:

1. An inkjet printer, comprising:

an inkjet head comprising an ink discharging surface;

a conveyer configured to convey a recording medium in a conveying direction;

a press part configured to press the recording medium from above and a rib configured to support the recording medium from below to deform the recording medium into a wave shape, the press part and the rib being arranged along an intersecting direction that intersects orthogonally with the conveying direction;

a memory configured to store gap information related to each one of gaps in a predetermined range along the intersecting direction between the ink discharging surface and a predetermined type of a recording medium in a predetermined wave shape, the gaps including a gap between the ink discharging surface and a top portion of the recording medium protruding toward the ink discharging surface and a gap between the ink discharging surface and a bottom portion of the recording medium recessed toward a side opposite from the ink discharging surface; and a controller configured to:

obtain information concerning a type of the recording medium to be used in a printing operation; and judge whether the predetermined type of the recording medium and the type of the recording medium to be used in the printing operation indicated in the obtained information are identical, wherein, when the controller judges that the predetermined type of the recording medium and the type of recording medium to be used in the printing operation are different, the controller corrects the gap information based on an orientation of fibers in the recording medium to be used in the printing operation and a ratio of amplitude in ripples in the wave shape formed in the recording medium to be used in the printing operation with respect to amplitude in ripples in the predetermined wave shape in the predetermined type of recording medium, and wherein the controller determines ink discharging timings to discharge ink from nozzles formed on the ink discharging surface of the inkjet head based on one of the corrected gap information and the gap information without correction.

2. The inkjet printer according to claim 1, wherein the amplitude in ripples of the recording medium to be used in the printing operation is smaller when the fibers in the recording medium align orthogonally to the conveying direction and is larger when the fibers in the recording medium align in parallel with the conveying direction.

3. The inkjet printer according to claim 1, wherein the amplitude in ripples of the recording medium is larger when the recording medium is regular printing paper and smaller when the recording medium is glossy paper.

4. The inkjet printer according to claim 1, wherein the corrected gap information includes correction of an amount of positional deviation of an ink droplet from the ink discharging surface of the inkjet head to land on the top portion of the wave shape in the recording medium and correction of an amount of positional deviation of an ink droplet from the ink discharging surface of the inkjet head to land on the bottom portion of the wave shape in the recording medium.

5. An inkjet printer, comprising:

an inkjet head comprising an ink discharging surface;

a conveyer configured to convey a recording medium in a conveying direction;

a press part configured to press the recording medium from above and a rib configured to support the recording medium from below to deform the recording medium into a wave shape, the press part and the rib being arranged along an intersecting direction that intersects orthogonally with the conveying direction;

a memory configured to store gap information related to each one of gaps in a predetermined range along the intersecting direction between the ink discharging surface and a predetermined type of a recording medium in a predetermined wave shape, the gaps including a gap between the ink discharging surface and a top portion of the recording medium protruding toward the ink discharging surface and a gap between the ink discharging surface and a bottom portion of the recording medium recessed toward a side opposite from the ink discharging surface; and a controller configured to:

obtain information concerning a type of the recording medium to be used in a printing operation; and judge whether the predetermined type of the recording medium and the type of the recording medium to be used in the printing operation indicated in the obtained information are identical, wherein, when the controller judges that the predetermined type of the recording medium and the type of recording medium to be used in the printing operation are different, the controller corrects the gap information based on an orientation of fibers in the recording medium to be used in the printing operation and a ratio of an amount of a gap between the ink discharging surface and the recording medium to be used in the printing operation and an amount of the gap between the ink discharging surface and the predetermined type of the recording medium;

wherein the controller determines ink discharging timings to discharge ink from nozzles formed on the ink discharging surface of the inkjet head based on one of the corrected gap information and the gap information without correction.

6. The inkjet printer according to claim 5, wherein the corrected gap information includes correction of an amount of positional deviation of an ink droplet from the ink discharging surface of the inkjet head to land on the top portion of the wave shape in the recording medium and correction of an amount of positional deviation of an ink droplet from the ink discharging surface of the inkjet head to land on the bottom portion of the wave shape in the recording medium.

* * * * *